United States Patent [19]

Gardner et al.

[11] Patent Number: 4,828,184

[45] Date of Patent: May 9, 1989

[54] SILICON MICROMACHINED COMPOUND NOZZLE

[75] Inventors: Robert C. Gardner, Taylor; William F. Horn, Plymouth; Mark K. Rhoades, Ferndale; Marvin D. Wells, Redford; Steve J. Yockey, Farmington Hills, all of Mich.

[73] Assignee: Ford Motor Company, Dearborn, Mich.

[21] Appl. No.: 231,365

[22] Filed: Aug. 12, 1988

[51] Int. Cl.[4] ..... B05B 1/00

[52] U.S. Cl. ..... 239/590.3; 239/590.5; 239/596; 239/601; 29/157 C

[58] Field of Search ..... 239/589, 590–590.5, 239/596, 601, 602, 591, 592, DIG. 19; 346/75, 140 R; 156/649, 657, 662; 29/157 C; 251/331, 368; 137/625.28

[56] References Cited

U.S. PATENT DOCUMENTS

| | | | |
|---|---|---|---|
| 4,007,464 | 2/1977 | Bassous et al. | 239/601 |
| 4,628,576 | 12/1986 | Giachino et al. | 29/157.1 R |
| 4,647,013 | 3/1987 | Giachino et al. | 251/331 |
| 4,756,508 | 7/1988 | Giachino et al. | 251/331 |
| 4,768,751 | 9/1988 | Giachino et al. | 29/157 C |

*Primary Examiner*—Andres Kashnikow
*Assistant Examiner*—Karen B. Merritt
*Attorney, Agent, or Firm*—Peter Abolins; Clifford L. Sadler

[57] ABSTRACT

A silicon compound nozzle has two generally planar parallel plates with offset openings coupled by a shear gap. Fluid flow in the shear gap is generally parallel to the plates and increases fluid dispersion.

15 Claims, 3 Drawing Sheets

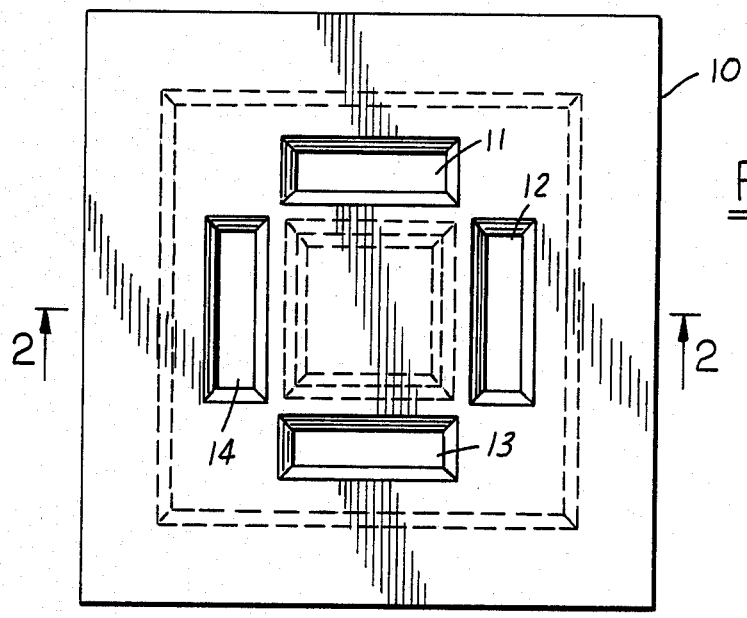
FIG. 1
FIG. 2
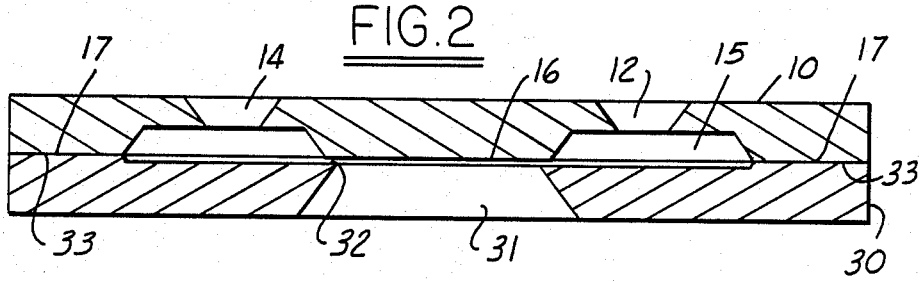
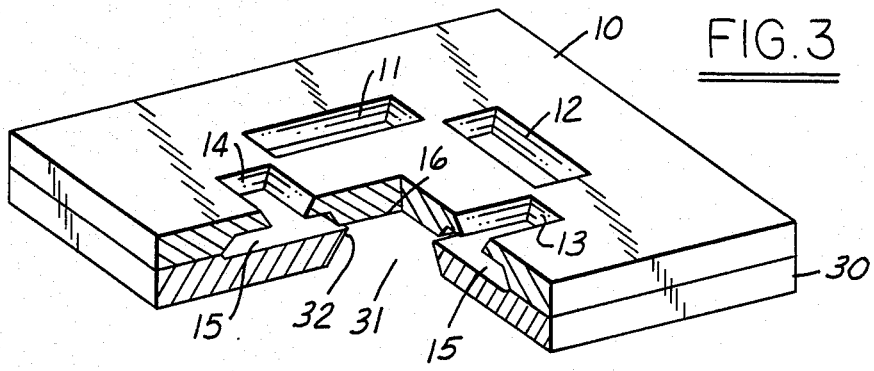
FIG. 3

SILICON MICROMACHINED COMPOUND NOZZLE

BACKGROUND OF THE INVENTION

1. Field of the Invention

This invention relates to micromachined silicon nozzles.

2. Prior Art

Silicon nozzles of various types are known for controlling fluid flow. For example, U.S. Pat. No. 4,007,464 issued to Bassous teaches the use of a single silicon plate with openings therethrough for controlling fluid flow.

U.S. Pat. No. 4,628,576 issued to Giachino et al and assigned to the assignee hereof teaches a valve wherein two silicon plates move with respect to each other and control fluid flow through an opening in one of the silicon plates.

In applications such as injecting fluid into combustion cylinders it is often desirable to have a very fine atomized dispersed fuel spray. Although known nozzles provide some such atomization, improvements would be desired. Further, it would be desirable to have a relatively simple nozzle structure which is easily fabricated to produce such a spray. These are some of the problems which this invention overcomes.

SUMMARY OF THE INVENTION

This invention includes a silicon nozzle having a first and a second generally planar silicon plate with openings for guiding fluid flow. A first opening in the first silicon plate is offset from a second opening in the second silicon plate. In the area between the first and second openings the silicon plates have a reduced thickness so as to form a shear gap for shear fluid flow substantially parallel to the plane of the first and second plates. Such shear flow causes turbulence and fluid dispersion advantageous for atomizing fuel in a combustion cylinder. In one embodiment, two shear flows are opposed to each other and collide so as to increase fluid dispersion.

A nozzle in accordance with an embodiment of this invention is advantageous because it is relatively easily fabricated using silicon micromachining techniques and produces a fluid flow with a high velocity exiting characteristic.

BRIEF DESCRIPTION OF THE DRAWINGS

FIG. 1 is a plan view of a compound nozzle assembly in accordance with an embodiment of this invention;

FIG. 2 is a section along 2—2 of FIG. 1;

FIG. 3 is a perspective, partly broken away view of the nozzle assembly of FIG. 1;

DETAILED DESCRIPTION OF THE INVENTION

Referring to FIGS. 1, 2 and 3, a compound silicon nozzle assembly includes a generally planar flow plate 10 cooperating with a generally planar orifice plate 30. Flow plate 10 is a symmetrical square silicon member with supply orifices 11, 12, 13 and 14 formed through flow plate 10 and positioned about the center of flow plate 10. Each opening has its longer side parallel to the closest edge of flow plate 10.

Figure 4:
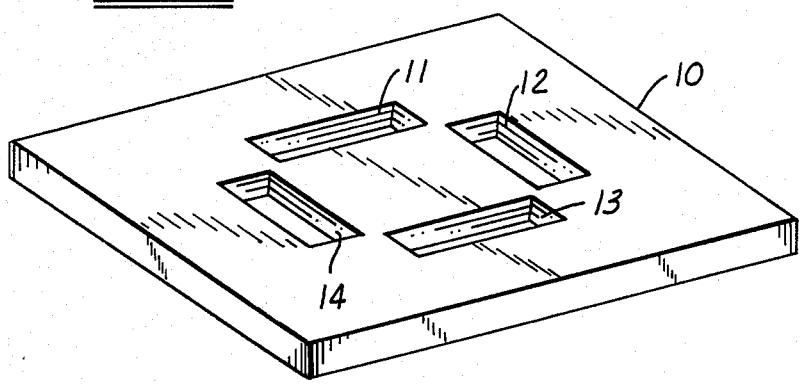
FIG. 4 is a top perspective view of the flow plate of the nozzle assembly of FIG. 3 in accordance with an embodiment of this invention.
Figure 5:
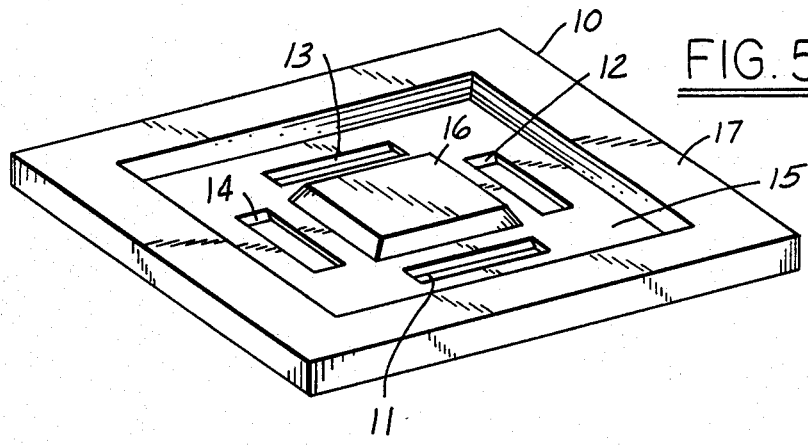
FIG. 5 is a bottom perspective view of the flow plate of FIG. 4 in accordance with an embodiment of this invention.

As shown in FIGS. 2, 4 and 5 the surface of flow plate 10 facing orifice plate 30 has a generally rectangular annular trough 15 formed around a mesa 16 and spaced from the edges of flow plate 10.

Figure 6:
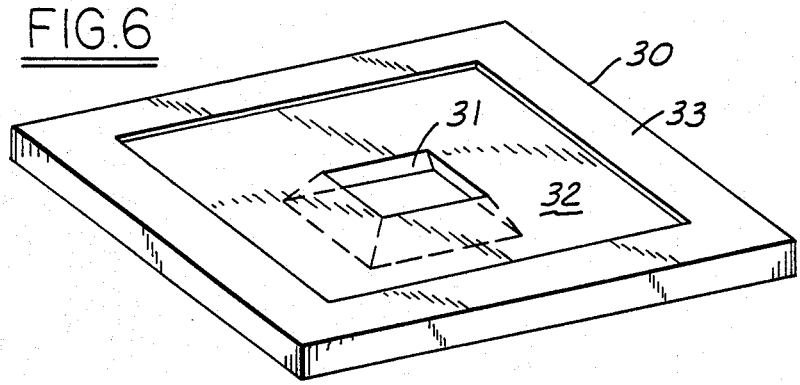
FIG. 6 is a top perspective view of the orifice plate of the nozzle assembly of FIG. 3 in accordance with an embodiment of this invention.
Figure 7:
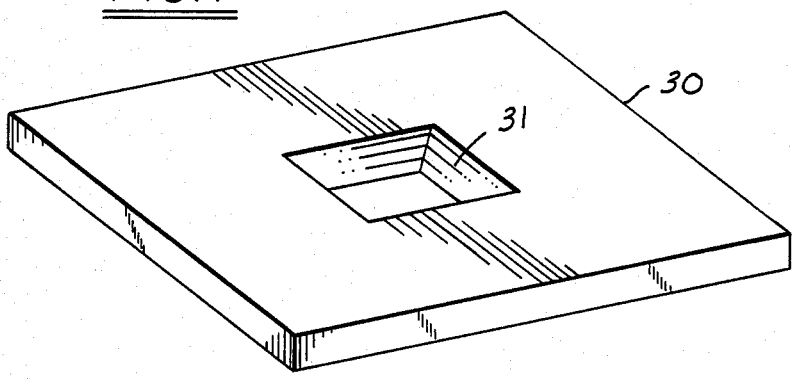
FIG. 7 is a perspective view of the bottom side of the orifice plate of FIG. 6.

FIGS. 6 and 7 show orifice plate 30. A central exhaust orifice 31 is formed through the middle of orifice plate 30 and tapers so as to have increasing cross-sectional area with increasing distance from the top surface of orifice plate 30 which faces flow plate 10. A raised wall 33 extends around the edge of orifice plate 30. Wall 33 of orifice plate 30 abuts the perimeter portion of flow plate 10 adjacent trough 15. A recessed shear orifice portion 32 of orifice plate 30 is bounded by wall 33 so that when orifice plate 30 is placed adjacent to flow plate 10, orifice plate 30 does not touch flow plate 10 within the boundaries of wall 33.

Referring to FIG. 2, exhaust orifice 31 of orifice plate 30 is aligned with flow mesa 16 of flow plate 10. Recessed shear orifice portion 32 spaces adjacent surfaces of orifice plate 30 from flow plate 10. Each of supply orifice 11, 12, 13 and 14 acts in conjunction with trough 15 to provide a fluid flow to shear orifice portion 32 and then through exhaust orifice 31 thereby passing through the combination of flow plate 10 and orifice plate 30.

As can best be seen in FIG. 2, the size of exhaust orifice 31 adjacent mesa 16 is smaller than the size of mesa 16. A shear gap is formed to the extent to which mesa 16 extends over shear orifice portion 32 of orifice plate 30. For example, after fluid flow enters supply orifice 14 it enters trough 15 and has a generally horizontal flow adjacent shear orifice portion 32 before passing through exhaust orifice 31.

To fabricate the compound nozzle assembly, two separate silicon plate configurations are micromachined and then bonded together. Fabrication includes known masking techniques of silicon wafers which are then exposed to etching to produce the orifices. The tapering nature of the orifices is a result of etching from one side. A typical taper is the etch angle for silicon material with a <100> crystallographic orientation. Double tapers, such as found in the combination of trough 15 and supply orifices 11, 12, 13 and 14 are the result of double sided etching. Mesa 16 is formed by masking and protecting the mesa area during etching. Similarly, wall 33 is formed by masking and protecting the area of wall 33 during etching of shear orifice portion 32. Shear orifice 32 and exhaust orifice 31 are etched from opposing sides so that they have opposing tapers. The fluid shear gap is produced by the overlap of the mesa and the bottom plate adjacent the exhaust orifice. This gap determines the flow rate and dispersion characteristics of the nozzle for fluid flow at a given pressure.

Various modifications and variations will no doubt occur to those skilled in the art to which this invention pertains. For example, the particular shape of the openings can be varied from that disclosed herein. These and all other variations which basically rely on the teachings through which this disclosure has advanced the art are properly considered within the scope of this invention.

We claim:

1. A silicon compound nozzle for guiding fluid flow includes:

a generally planar first silicon plate having a first opening formed therethrough;

a generally planar second silicon plate, adjacent to, parallel to, and in a fixed relationship to said first silicon plate, having a second opening formed therethrough and offset from said first opening in said first silicon plate, and said silicon compound nozzle having a first area of reduced thickness between said first and second openings so as to form a first shear gap for fluid flow substantially parallel to the plane of said first and second plates.

2. A silicon nozzle as recited in claim 1 further comprising a third opening in said first plate offset from said first opening;

said third and second openings being offset from each other and acting in cooperation with a second area of reduced thickness between said third and second openings in said silicon compound nozzle forming a second shear gap for fluid flow substantially parallel to the plane of said first and second plates so that fluid flow going through said first shear gap hits fluid flow going through said second shear gap and exits through said second opening.

3. A silicon nozzle as recited in claim 2 further comprising a fourth opening in said first plate offset from said first, second and third openings and acting in cooperation with a third area of reduced thickness between said fourth and second openings in said silicon compound nozzle forming a third shear gap for fluid flow substantially parallel to the plane of said first and second plates so that fluid flow going through said first and second shear gaps hits fluid flow going through said third shear gap and exits through said second opening.

4. A silicon nozzle as recited in claim 3 wherein said first plate contains said first, second, third, and a fourth generally rectangular openings positioned around a central mesa area, said central mesa area being aligned with said second opening in said second plate and said first, second and third shear gaps being defined by the surface of said mesa and the adjacent surface of said second silicon plate.

5. A silicon nozzle as recited in claim 4 where in the extent of the shear gap overlap between said mesa and said second silicon plate adjacent said second opening is relatively small compared to the size of said second opening.

6. A silicon nozzle as recited in claim 5 wherein the surface of said second silicon plate facing said first silicon plate has a recess adjacent each opening in said first silicon plate.

7. A silicon nozzle as recited in claim 6 wherein said first plate includes an annular recess around said central mesa, said recess being aligned with each of said openings in said first plate.

8. A silicon nozzle as recited in claim 7 wherein each of said openings in said first plate tapers and decreases in cross sectional area with decreasing distance to said second plate.

9. A silicon nozzle as recited in claim 8 wherein said annular recess in said first plate tapers and decreases in cross sectional area with increasing distance from said second plate.

10. A silicon compound nozzle for guiding fluid flow includes:

a generally planar silicon flow plate having a plurality of supply orifices formed therethrough arranged generally symmetrically about the center of said flow plate, an annular trough formed on the underside of said flow plate intersecting said supply orifices, and a mesa at the center of said trough;

a generally planar silicon orifice plate having an exhaust orifice formed therethrough, said orifice plate having a fixed relationship to said flow plate, the opening of said exhaust orifice at the upper side of said orifice plate being aligned with and smaller in lateral extent than said mesa, a raised perimeter wall around said orifice plate, and a reduced thickness shear gap area; and a portion of said mesa and said shear gap area being aligned, and the region adjacent said mesa and said shear gap area being in communication with said exhaust orifice and said supply orifices.

11. A silicon compound nozzle for guiding fluid flow includes:

a generally planar first silicon plate having first, second, third and fourth openings formed therethrough and offset from each other;

a generally planar second silicon plate having a fifth opening therethrough and offset from said first, second, third and fourth opening in said first silicon plate, said second plate having a fixed relationship to said first plate;

said silicon compound nozzle having an area of reduced thickness between said fifth opening and each of said first, second, third and fourth openings so as to form a shear gap for fluid flow substantially parallel to the plane of said first and second plates, and so that fluid flow going through said shear gap from said first, second, third and fourth opening collides and exits through said fifth opening;

said first, second, third and fourth openings being generally rectangular and positioned around a central mesa area, said central mesa area being aligned with said fifth opening in said second plate and said shear gap being defined by the surface of said mesa and the adjacent surface of said second silicon plate, the extent of the shear gap overlap between said mesa and said second silicon plate adjacent said fifth opening being relatively small compared to the size of said fifth opening;

said first plate including an annular recess around said central mesa, said annular recess being aligned with each of said first, second, third and fourth openings in said first plate, said annular recess in said first plate tapering and decreasing in cross sectional area with increasing distance from said second plate; and each of said first, second, third and fourth openings in said first plate tapering and decreasing in cross sectional area with decreasing distance to said second plate.

12. A method of forming a fixed gap compound silicon nozzle including:

forming a generally planar first silicon plate with an opening;

forming a generally planar second silicon plate with a second opening, offset from the first opening, said second plate being held in a fixed relationship to said first plate;

forming a fixed gap fluid flow path between the first and the second opening at the interface between the first and second silicon plates.

13. A method as recited in claim 12 wherein the offset between the first and second openings is such that the opening surface of th first opening does not overlap the opening surface of the second opening.

14. A method as recited in claim 13 wherein the step of forming a fluid path between the first and the second openings includes:

forming in the first silicon plate a mesa adjacent the first opening and sized to be sufficiently forming in the second plate a shear gap recess of reduced thickness adjacent the second opening;

positioning the first and second silicon plates adjacent each other so that the mesa is positioned to extend beyond the second opening over the shear gap recess thereby forming a gap for fluid flow generally parallel to the plane of the first and second silicon plates.

15. A method as recited in claim 14 further comprising the steps of:

forming a third opening in said first silicon plate offset from both said first and second openings;

forming a shear fluid flow path between the first and second openings so that fluid flow from the first opening to the second opening intersects fluid flow from the third opening to the second opening.

* * * * *